US007559496B2

(12) United States Patent
Shewchuk

(10) Patent No.: US 7,559,496 B2
(45) Date of Patent: Jul. 14, 2009

(54) PILL CRUSHING MACHINE

(76) Inventor: James G. Shewchuk, 1414 Erin St., Winnipeg, Manitoba (CA) R3E 2S8

( * ) Notice: Subject to any disclaimer, the term of this patent is extended or adjusted under 35 U.S.C. 154(b) by 1138 days.

(21) Appl. No.: 10/359,619

(22) Filed: Feb. 7, 2003

(65) Prior Publication Data

US 2003/0155458 A1 Aug. 21, 2003

(30) Foreign Application Priority Data

Feb. 7, 2002 (CA) ..... 2370988

(51) Int. Cl.
*B02C 19/00* (2006.01)

(52) U.S. Cl. ..... 241/169; 241/169.2; 241/DIG. 27

(58) Field of Classification Search ..... 241/DIG. 27, 241/283, 169, 270, 169.2
See application file for complete search history.

(56) References Cited

U.S. PATENT DOCUMENTS 5,618,004 A * 4/1997 Klearman et al. ..... 241/21
5,823,451 A * 10/1998 Sharpe ..... 241/169.2
6,059,209 A * 5/2000 Barson ..... 241/168
6,637,685 B1 * 10/2003 Kruger ..... 341/169.1

* cited by examiner

*Primary Examiner*—Mark Rosenbaum

(57) ABSTRACT

Nestable trays are part of a pill crushing device. The trays have cylindrical midportions, spherical end portions and a planar flange. The pill crushing device has an anvil or mortar portion to engage a bottom tray, and a hammer or pestle portion to engage a top tray. The anvil portion has a recess the perimeter of which supports the bottom tray flange. A finger gap is conveniently left in the perimeter for access to the bottom tray. The hammer portion extends between two pivotable lever arms and has sufficient tolerance to allow limited independent movement of the lever arms, which in turn allows relative movement of the trays to crush pills. The hammer can contact the top tray, and may be of cylindrical form with hemispherical ends, which can itself nest in the top tray, in another version it is slightly larger and does not nest but engages the tray near the top. In a third version the cylindrical hammer has end blocks, the cylinder registers the top tray, while the blocks engage the top tray flange. Another hammer version has gripping blocks, separated by a connector tube, which have concave grooves to engage the end flanges of the top tray.

18 Claims, 5 Drawing Sheets

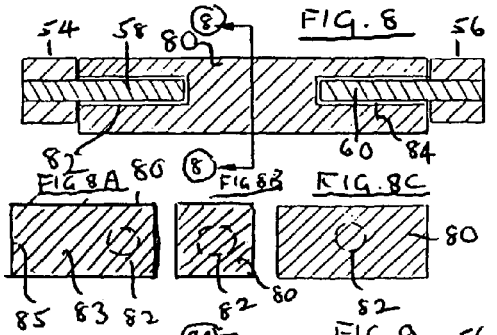
FIG. 8
54
58
80
8
56
82
60
84
FIG 8A
FIG 8B
FIG. 8C
85
83
82
80
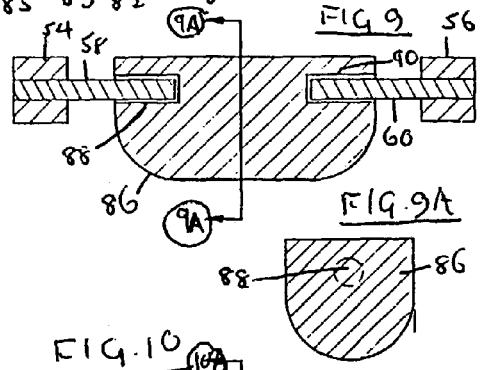
FIG 9
54
58
9A
90
56
88
60
86
FIG. 9A
88
86
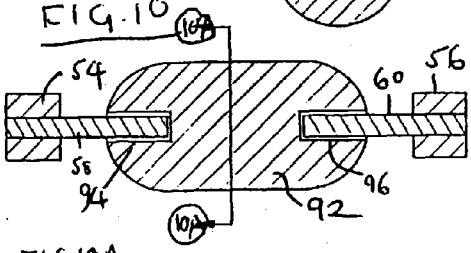
FIG. 10
10A
54
60
56
58
94
96
92
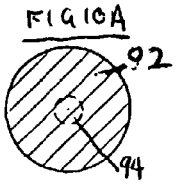
FIG 10A
92
94
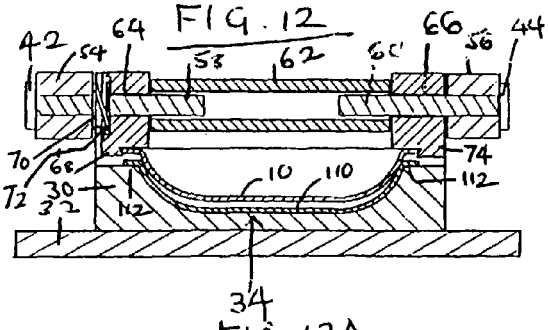
FIG. 12
42
54
64
58
62
60
66
56
44
70
68
72
30
32
112
10
110
74
112
34
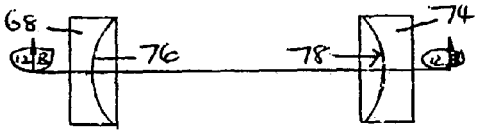
FIG. 12A
68
76
78
74
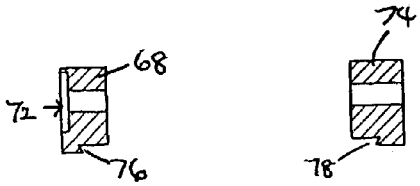
FIG. 12B
68
72
76
74
78
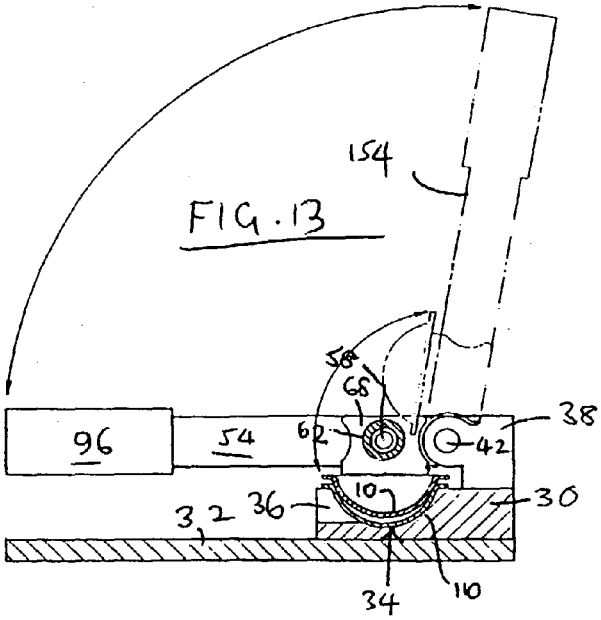
FIG. 13
154
58
68
96
54
62
42
38
10
36
30
32
34
10

FIG. 14
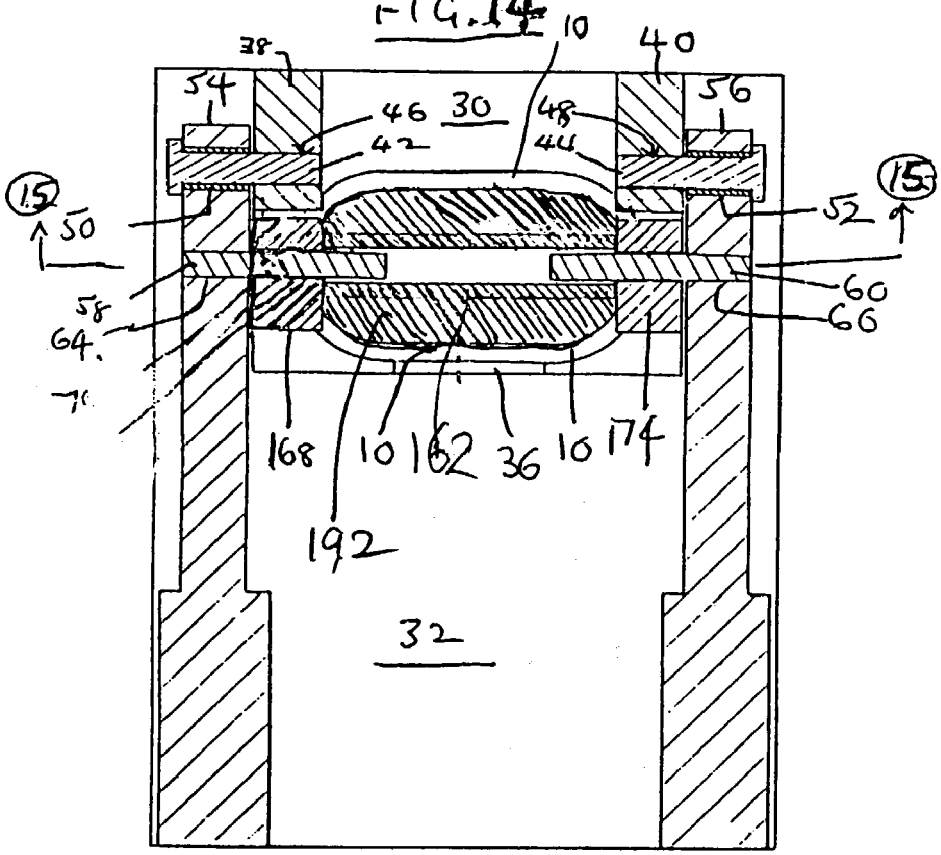
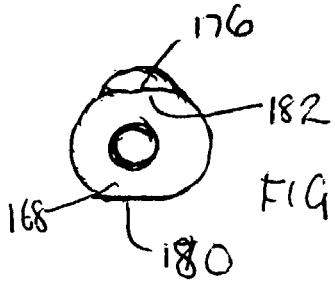
FIG 16
FIG 17
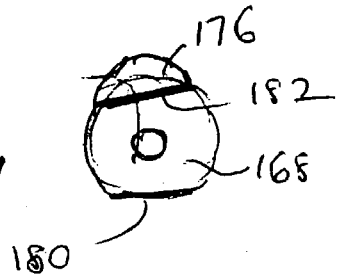

PILL CRUSHING MACHINE

This invention is relates to devices and machines for crushing medical pills or tablets into powder.

The present invention provides a tray in which pills are crushed. Since these trays nest, pills can be crushed between an top tray acting as a hammer or pestle, and a bottom tray acting as an anvil or mortar. A machine is provided to force paired trays together, which has paired pivoted handles engaging a cross member to engage the upper tray. The cross member allows a degree of independent movement of the handles. A support has a recess or aperture to receive nestingly the lower tray. The independent movement of the handles allows wiggling of the cross member and the nesting trays relative to each other, which as discussed below, crushes pills into powder.

Although the invention is described and referred to specifically as it relates to specific devices, structures, machines and methods for crushing medical pills, it will be understood that the principles of this invention are equally applicable to similar devices, structures and methods for crushing medical pills, and accordingly, it will be understood that the invention is not limited to such devices, structures, machines and methods for crushing medical pills.

BACKGROUND

Many hospital and nursing home patients cannot swallow medicine in pill or tablet form. Their medicine is crushed to powdered form and taken mixed with food. Although as discussed under prior art many pill crushing devices are known, they are not used because they don't work well. The commonest method of pill crushing is to place the pill or pills, in a paper medication cup, also called a paper crushing cup, or paper pleated cup on a surface. A second top cup stackable or nestable with the first bottom cup is dropped into it. Then a hammer of suitable size is smashed down into the top cup breaking, crushing and/or powdering the pill(s) or tablet(s), between the top and bottom cups. Each patient requires their medicine to be separately crushed, to avoid cross contamination. Repeated hammering noticeably and significantly affects the arms and shoulders of the medical staff, typically nurses, often female, who do it.

PRIOR ART

The prior art of which applicant is aware, is herein made of reference. U.S. Pat. No. 2,631,786 to Morgan et al., 17, Mar. 1953, U.S. Pat. No. 3,915,393 to Elkins, 28 Oct. 1975, U.S. Pat. No. 4,003,523 to Doolittle, 18 Jan. 1977, U.S. Pat. No. 4,092,005 to Benroth, 30 May. 1978, U.S. Pat. No. 4,121,775 to Roseberg et al., 24 Oct. 1978, U.S. Pat. No. 4,273,297 to Rinfret et al., 16 Jun. 1981, U.S. Pat. No. 4,275,851 to Weese, 30 Jun. 1981, U.S. Pat. No. 4,341,356 to Hiott et al., 27 Jul. 1982, U.S. Pat. No. 4,887,755 to Gibilisco, 19 Dec. 1989, U.S. Pat. No. 4,967,971 to Smith, 6 Nov. 1990, U.S. Pat. No. 5,025,996 to Lavin et al., 25 Jun. 1991, U.S. Pat. No. 5,067,666 to Sussman, 26 Nov. 1991, U.S. Pat. No. 5,118,021 to Fiocchi, 2 Jun. 1992, U.S. Pat. No. 5,123,601 to Lavin et al., 23 Jun. 1992, U.S. Pat. No. 5,148,995 to Hurst, 22 Sep. 1992, U.S. Pat. No. 5,178,337 to Lupoli, 12 Jan. 1993, U.S. Pat. No. 5,322,227 to Fiocchi, 21 Jun. 1994, U.S. Pat. No. 5,376,072 to Klearman et al., 27 Dec. 1994, U.S. Pat. No. 5,464,393 to Klearman et al., 7 Nov. 1995, U.S. Pat. No. 5,472,421 to Klearman et al., 5 Dec. 1995, U.S. Pat. No. 5,478,311 to Klearman, 26 Dec. 1995, U.S. Pat. No. 5,531,386 to Jensen, 2 Jul. 1996, U.S. Pat. No. 5,553,793 to Klearman et al., 10 Sep. 1996, U.S. Pat. No. 5,618,004 to Klearman et al., 8 Apr. 1997, U.S. Pat. No. 5,823,451 to Sharpe, 20 Oct. 1998, U.S. Pat. No. 5,863,001 to Schulze, 26 Jan. 1999, U.S. Pat. No. 5,915,637 to Parsons, 29 Jun. 1999, U.S. Pat. No. 5,924,636 to Calderon, 20 Jul. 1999, and U.S. Pat. No. 6,059,209 to Barson, 9 May 2000, teach pill crushing devices, as do Design Pat. No. 196,726 to Bull, 29 Oct. 1963, and U.S. Pat. No. 405,889 to Parsons, 16 Feb. 1999. The commonest drawback is that the device does not permit of repeated use, which without thorough washing or cleaning, would cause cross contamination of medicine. Two devices, Elkins and Barson teach bases with pivoted hammers, which crush pills between paper cups in a recess. Parsons teaches a base with an upright anvil against which a pivoted platen crushes a pill in a plastic pouch. Schulze teaches a nutcracker having a semicylindrical boss pivoting into and matingly fitting a semicylindrical recess to crush a pill in a plastic pouch. None of these is really satisfactory for continual use on a repeated daily basis.

Investigation showed that when crushed between flat surfaces pills cracked remaining largely intact, rather than fragmenting into powder, requiring repeated crushing. Further investigation showed that when large and small pills were crushed together, often only large pills were crushed, the small pills staying intact.

The principal object of the invention is to provide a tray for crushing pills, which has a part cylindrical recess with part spherical ends. A subsidiary object of the invention is to provide the tray with a planar surrounding flange lying in a chord to the axis of rotation of the cylindrical recess. A further subsidiary object of the invention is that one tray is nestable or stackable within an identical. A further subsidiary object of,the invention is to provide a device to crush pills between top and bottom trays, by applying an upper hammer to the top tray and a lower anvil to the bottom tray. A further subsidiary object is to provide hammer means attached to paired lever-arms having limited independent movement. A further subsidiary object of the invention is to provide such limited independent movement by sockets of suitable tolerance in the hammer engaging pins in the levers. A further subsidiary object of the invention is to shape the hammer to engage the interior of the top tray. A further subsidiary object of the invention is to provide the hammer with means to grip the flange of the top tray. An alternative further subsidiary object of the invention is to provide the hammer with means to engage the flange of the top tray. A further subsidiary object of the invention is to provide sufficient pairs of trays for each device to crush pills for a number of patients.

DESCRIPTION OF THE INVENTION

In a first broadest aspect the invention is directed to a recessed tray for crushing pills, which has a concave inner surface comprising a central portion having a part cylindrical inner surface joining opposed end portions having spherical inner surfaces, the inner surfaces having a first radius, whereby the inner spherical surfaces merge smoothly into the inner cylindrical surface. It also has a convex outer surface comprising a central portion having a part cylindrical outer surface joining opposed end portions having spherical outer surfaces, the outer surfaces having a second radius greater than the first radius by the thickness of the tray. The cylindrical surface forms a radial angle less than 180°, so that it is possible for one tray to fit within another. As those skilled in the art understand inner and outer cylindrical surfaces are concentric as are the inner and outer spherical surfaces at each end. Preferably the tray has a surrounding flange lying in a plane which is chordal to the axis of rotation of the cylindrical surfaces. Two such trays substantially nest with their flanges parallel, but not touching. As those skilled in the nesting art understand, two such trays having a finite thickness cannot touch each other completely, that is the entire outer surface of one cannot touch the entire inner surface of the other. When they rest in contact, with their flanges parallel, there's a line of contact running around the inside of one tray and the outside of the other. Otherwise there is a space between the trays. The trays may be rocked, wiggled, or jiggled, remaining in contact, altering the size and shape of the intertray space. Pills placed in this space are cracked by relative motion of the trays changing this space, and the cracked pills are displaced by the relative motion of the trays. The line of contact of the trays prevents, or greatly reduces the chance of pills or fragments escaping from between the trays during crushing. The trays are typically stainless steel, partly for endurance and partly for ease of cleaning, to avoid contamination from earlier use. It is possible that a tray with a flanged recess of ellipsoidal rotation, instead of a partial cylinder with partial spherical ends, would work as well, however it is difficult to manufacture a die for such trays easily, compared to one for a cylinder with spherical ends. The trays are made of about 20 gauge stainless steel sheet with an internal radius of about ⅝ inch, the cylindrical portion is about 1¼ inch long, the plane of the flange is about ⅛ inch below the centre of rotation of the cylinder, and the flange projects about ⅛ inch. The trays are about 2¾ inch long by about 1½ inch wide by about ½ inch deep. As those skilled in the art appreciate these figures can be varied to a considerable extent without affecting their function or effect. Trays of the given dimensions have been found to fit nearly all pills, and crush the smallest ones, advantageously they were found to crush a mixture of pills.

In another broad aspect the invention is directed to a pill crushing device comprising in combination a hammer portion to engage a pestle tray and an anvil portion to engage a mortar tray, the trays being substantially identical and substantially nesting, whereby pills may be crushed between the trays.

In a further broad aspect the invention is directed to a pill crushing device comprising an anvil portion to receive a bottom tray with a flange to act as a mortar. The anvil has a recess having a perimeter adapted to engage the flange of the bottom tray. A hammer portion is adapted to engage a top tray having a flange. The trays are substantially identical and nestable. Opposed paired lever arms are pivoted adjacent their ends about first paired aligned first opposed pivots, preferably in said anvil portion. The hammer portion is pivoted about second paired aligned second pivots spaced apart from the first pivots on the lever arms. The hammer portion has sockets engaging connecting pins forming the second pivots. The hammer portion is rotatable from a first upper position to a second lower position, wherein the hammer portion engages the top tray, the top tray engages the bottom tray, and the bottom tray engages the recess. Preferably the sockets of the hammer portion engage the connecting pins with sufficient tolerance to allow the lever arms limited independent motion. The hammer portion may be a member of square cross section extending between the connecting pins. Again it may be a member of rectangular cross section extending between the connecting pins. It is preferred that the hammer portion registers with the trays and the recess. Conveniently the trays comprise a part cylindrical recess, with part spherical ends and a planar flange. The hammer portion may comprise a part cylindrical portion joining part spherical ends, the ends comprising the sockets. The hammer portion may comprise a central cylindrical portion with part spherical ends. The hammer portion may comprise a central cylindrical portion to register and align the cylindrical tray recess, combined with end blocks to engage the tray flange. Otherwise the hammer portion comprises spring loaded means to engage the top tray. Conveniently the anvil portion is associated with a mounting plate, if they are separate the lever arms may be pivoted either by first pivots mounted in the anvil or by first pivots mounted in the mounting plate. Preferably the first pivots are mounted in the anvil portion. Generally the anvil is either integral with or fixedly mounted on the mounting plate. The anvil portion contains a recess with a perimeter to receive a bottom tray having a part cylindrical mid portion, part spherical end portions and planar flange, the planar flange resting on the perimeter. Opposed aligned spaced apart first pivots engage paired opposed lever arms adjacent their ends, as noted above preferably in the anvil portion itself. Opposed aligned spaced apart second pivots are spaced apart from the first pivots on the lever arms. In one version the hammer portion has a cylindrical mid portion and hemispherical ends. Sockets in the spherical ends engage connecting pins forming the second pivots, with sufficient tolerance to allow the lever arms limited independent motion. The hammer portion is rotatable from a first upper position to a second lower position, wherein the hammer portion engages a top tray having a part cylindrical mid portion, part spherical end portions and planar flange, the top and bottom trays being substantially identical and nestable. The hammer means registers with the top tray, the top tray engages the bottom tray, and the bottom tray engages the recess. The cylindrical portion of the hammer portion may be substantially the same radius as the top tray and can fit inside the top tray. More preferably the cylindrical portion of the hammer portion has a larger radius than the top tray and contacts the top tray only adjacent the top thereof. In another plate mounted version, the hammer includes end gripping blocks and a central connector. The connecting pins forming the second pivots, pass through opposed gripping blocks, and engage a connector tube with sufficient tolerance to allow the lever arms limited independent motion. One of the gripping blocks is spring loaded, both gripping blocks engage the end flange of a top tray having a part cylindrical mid portion, part spherical end portions and planar flange. The hammer portion is rotatable from a first upper position to a second lower position, wherein the hammer portion engages a top tray having a part cylindrical mid portion, part spherical end portions and planar flange, the top and bottom trays being substantially identical and nestable. The hammer means registers with the top tray, the top tray engages the bottom tray, and the bottom tray engages the recess. Preferably both gripping blocks comprise concave grooves to grip the end flange of the top tray. In yet another plate mounted version, the hammer portion has a central cylindrical portion and paired end blocks. The connecting pins pass through apertures in the opposed end blocks, and engaging axial apertures in the central cylindrical hammer, with sufficient tolerance to allow said lever arms limited independent motion. The end blocks engage the end flange of a top tray having a part cylindrical mid portion, part spherical end portions and planar flange. The cylindrical portion of the hammer registers and aligns the cylindrical midportion of the top tray. The hammer is rotatable from a first upper position to a second lower position. The top and bottom trays are substantially identical and nestable. The hammer means registers with the top tray, the top tray engages the bottom tray, and the bottom tray engages the recess. Preferably the end blocks comprise planar portions to engage the end flange of said top tray. Also preferably the end blocks have external flanges to engage the lever arms, to restrict the angular motion of the end blocks around the connecting pins with respect to the lever arms and keep their planar portions in contact with the tray flange.

In all the above noted anvil portions, the recess preferably has a finger gap in its perimeter to allow access to the bottom tray.

BRIEF DESCRIPTION OF THE DRAWINGS

FIG. 8 shows a front sectional view of an alternative hammer arrangement of the invention.

FIGS. 8A, 8B and 8C show a side sectional view of embodiments of FIG. 8.

FIG. 9 shows a front sectional view of another alternative hammer arrangement of the invention.

FIG. 9A shows a side sectional view of the embodiment of FIG. 9.

FIG. 10 shows a front sectional view of an alternative hammer arrangement of the invention.

FIG. 10A shows a side sectional view of the embodiment of FIG. 14.

FIG. 12 shows a sectional front view of the embodiment of FIG. 11.

FIG. 12A shows a bottom view of a detail of FIG. 12.

FIG. 12B shows a sectional front view of the detail of 12A.

FIG. 13 shows a side part sectional view of the embodiment of FIGS. 11 and 12.

FIG. 14 shows a part sectional top view of another embodiment of the invention.

FIGS. 16 and 17 show details of blocks of the embodiment of FIG. 14.

DESCRIPTION OF THE PREFERRED EMBODIMENTS

Figure 1:
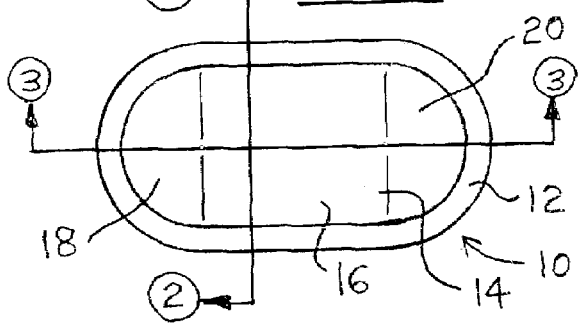
FIG. 1 shows a top view of a tray of the invention.
Figure 2:
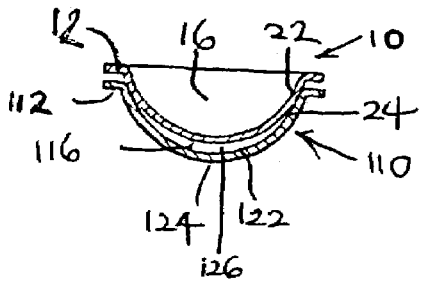
FIG. 2 shows a transverse sectional view of nesting trays of FIG. 1.
Figure 3:
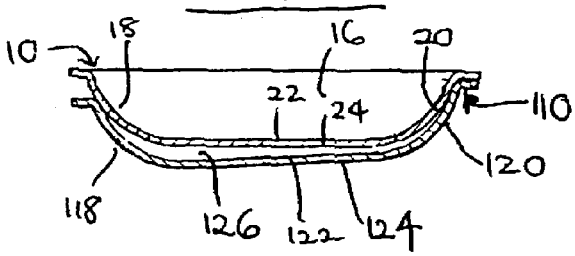
FIG. 3 shows a longitudinal sectional view of nesting trays of FIG. 1.
Figure 4:
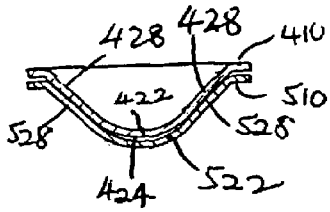
FIG. 4 shows a transverse section of another embodiment of nesting trays of the invention.

The invention is now illustrated by reference to preferred embodiments thereof. Numeral 10 refers to a tray of the invention, which has a planar flange 12, and a recess 14, which has half cylindrical central portion 16 and end quarter spherical portions 18 and 20. The tray is preferably stainless steel, so that it is hard wearing and doesn't rust. The preferred stainless steel is type 304, since it is one of the easier stainless steels to work with. Preferably tray 10 is electropolished to improve surface finish and reduce adhesion of powdered pharmaceutical medicines. Inside surface 22 of half cylinder 16, and outside surface 24 are concentric. Tray 110 is identical with semicylindrical recess portion 116 and flange 112. When tray 10 rests within semicylindrical recess 116 of tray 110, outside surface 24 of tray 10, touches inside surface 122 of tray 110 only along the sides leaving gap 126 of transverse crescent sectional form. Flanges 12 and 112 are preferable for ease of manufacture. As can be seen in FIG. 3, when tray 10 rests in semicylindrical recess 116 of identical tray 110, there is room for considerable play in that the end portions 18 and 20 of tray 10 can move up and down with respect to end portions 118 and 120 of tray 110. allowing a wiggling effect. Similar but much less wiggling is possible transversely. Another form of tray was tested, identical trays 410 and 510 had linear tangential portions 428 and 528 above inside cylindrical surfaces 422 and 522, at an approximate angle of 45°, again outside surface 424 nested almost exactly within inside surface 522, to within about 1/64 inch or less to about 1/100 inch. Both versions were tested by crushing pills by medical staff for a number of patients, and it was found that the embodiment of FIGS. 1 to 3 worked best. It was conjectured without prejudice that the trays with concentric surfaces, which nested less closely allowed more longitudinal, (and transverse) wiggling or play, and thus pushed cracked pills apart allowing easier crushing. The medical staff found that these crushed pills more easily and smaller. An added bonus was that when pills of different size were crushed together, the embodiment of FIGS. 1 to 3, nearly always were observed to crush the smaller pill, as well as the larger. The embodiment of FIG. 4 didn't always do so, smaller pills sometimes escaping from the trays. Initial testing was performed using Tylenol® (trademark for painkiller) tablets, without problems. Several independent tests were run by staff at different medical establishments, most reported no adhesion of powdered pharmaceuticals, while some did, cause uncertain. It is thought, without prejudice, that this was due to crushing of tablets or pills with coatings, intended to dissolve in the recipient's stomach.

Figure 5:
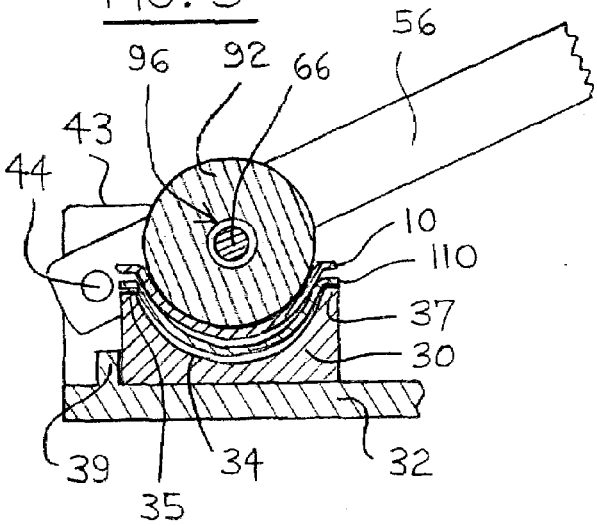
FIG. 5 shows a sectional side view of an embodiment of the invention.
Figure 6:
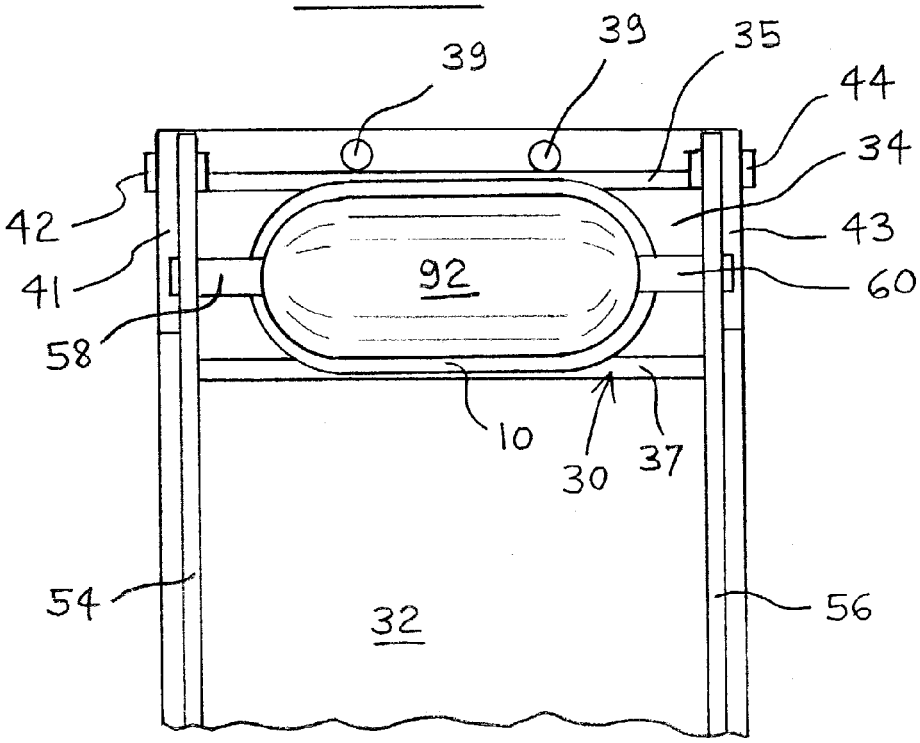
FIG. 6 shows a top view of the embodiment of FIG. 5.

In FIG. 5, base (tray holder) 30 is loose, it may however may be mounted directly on to a substrate, or on to mounting plate 32, which itself may be mounted on a substrate. The substrate may be a bench, or counter, or the like, but most typically is a medical cart, or an element thereof. Medical carts come in a plethora of forms, and are often proprietary to a particular pharmaceutical company, which may itself have many different medical carts. Accordingly there can be no specific way of mounting base or mounting plate onto a substrate, but each (type of) medical cart will have a different way of mounting. Base 30 has recess 34 to nestingly receive lower tray 110, for ease of placing and removing tray 110, recess 30 may either be shaped to receive lower tray 110, or merely edges 35 and 37 may be spaced so as to support the straight part of flange 112 of tray 110. In FIG. 5, hammer 92 is cylindrical with hemispherical ends and has dimensions identical to the interior of trays 10 and 110. It has socket 96 to receive pivot pin 60. Pivot pin 60 itself is conveniently slightly smaller (about 1/64 inch) in diameter than socket 94, to allow wiggling of hammer 92. Lugs 39 hold base 30 in place during pill crushing. As shown in FIGS. 5 and 6, mounting plate 32 has upward lugs 41 and 43 to engage connector pins 58 and 60 and pivot pins 42 and 44.

Figure 7:
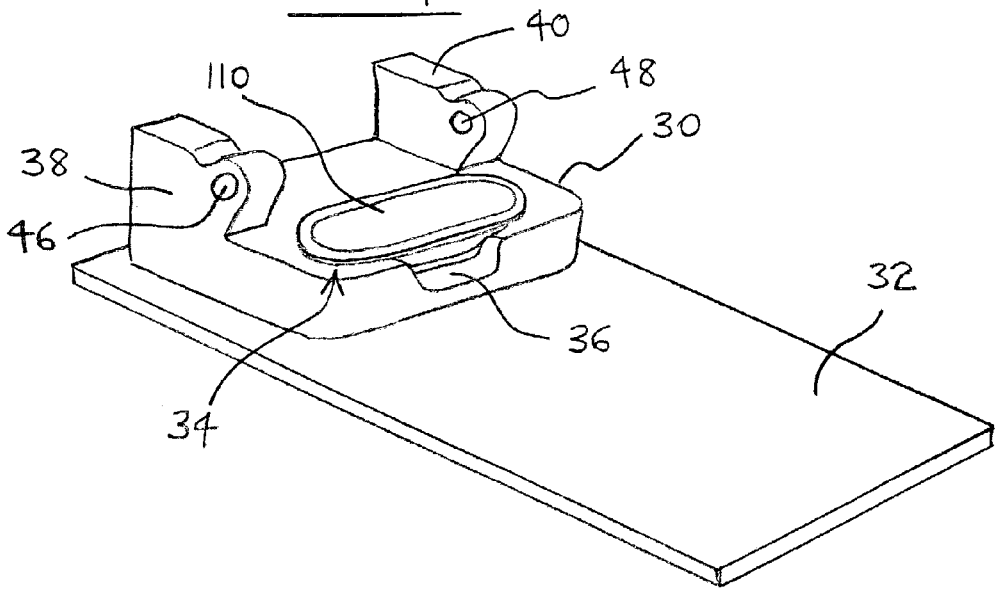
FIG. 7 shows a perspective view of a base (tray holder) of the invention.

In FIG. 7, a variation is shown here recess 34 at its edges supports tray 110 along its flange, and has gap 36 to allow finger or thumb entry to grip tray 110. Base 30 has lugs 38 and 40, which receive pivot pins 42 and 44 in pivot apertures 46 and 48 respectively.

Besides hammer 92, other types of hammer were tested, shown in FIGS. 8 to 10A. In FIG. 8, block 80 of generally rectangular form is journalled at sockets 82 and 84 to receive connector pins 58 and 60 from lever arms 54 and 56, respectively. When block 80 is of rectangular cross section and eccentrically mounted as in FIG. 8A, portion 83 hangs down and flat bottom surface 85 engages upper tray 10 on flange 12. When block 80 is of square cross section as in FIG. 8B, one surface engages flange 12 of tray 10. When block 80 is of rectangular cross section and centrally mounted as in FIG. 8C, one surface engages flange 12 of tray 10. All three were tested and found to work to press down tray 10 into tray 110 crushing pills, by independent movement of lever arms 54 and 56. Hammer 86 of generally half cylindrical form with generally quarter spherical ends is journalled at sockets 88 and 90 to receive connector pins 58 and 60 from lever arms 54 and 56, respectively. The bottom surface matingly engages interior recess 14 of tray 10, which can be pressed down. In the embodiment shown in FIGS. 5 and 6 with loose base 30, it registers the trays together into in recess 34, and similarly in the embodiment of FIG. 7. Hammer 92 of generally cylindrical form with half spherical ends is journalled at sockets 94 and 96 to receive connector pins 58 and 60 from lever arms 54 and 56, respectively. The bottom surface of hammer 92 matingly engages interior recess 14 of tray 10, which can be pressed down. Opposed connector pins 58 and 60 allow relative movement of arms 54 and 56, giving a wiggling effect to the relative motions of trays 10 and 110. It was found that the form of hammer 92 gave least problems, when used with the base shown in FIG. 7, which was the one most liked by nursing staff testing the various devices. The drawback of cylindrical hammer 92 fitting matingly or snugly within recess 14 was that wear was considered unnecessarily high. Hammer 92 was modified to have a slightly larger radius than the interior of tray 10. Originally both tray and hammer had radii of ⅝ inch, although as understood by those skilled in the art, this is illustrative only. By keeping the tray radius at ⅝ inch while expanding the hammer radius to 21/32 inch, the hammer or block only contacted the tray along the inner top edge. Sockets 82, 84, 88, 90, 94, 96 are used rather than a bore extending through the hammer so that the position of hammers 80, 86 and 92 are kept in relative position between lever arms 54 and 56.

Figure 11:
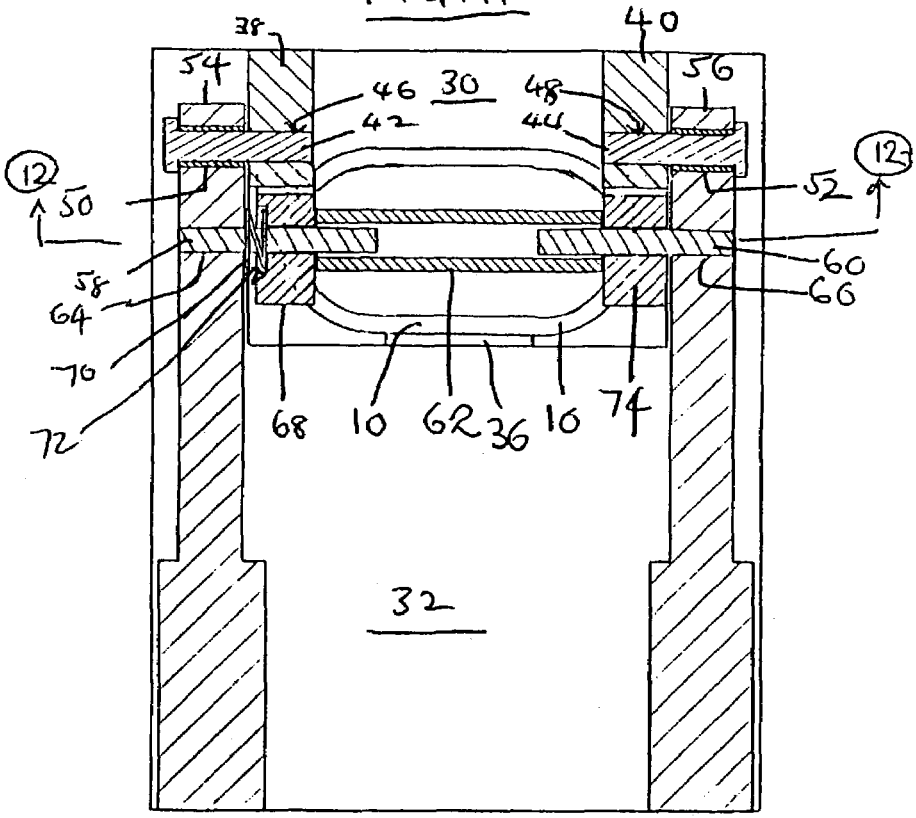
FIG. 11 shows a part sectional top view of another embodiment of the invention.
Figure 15:
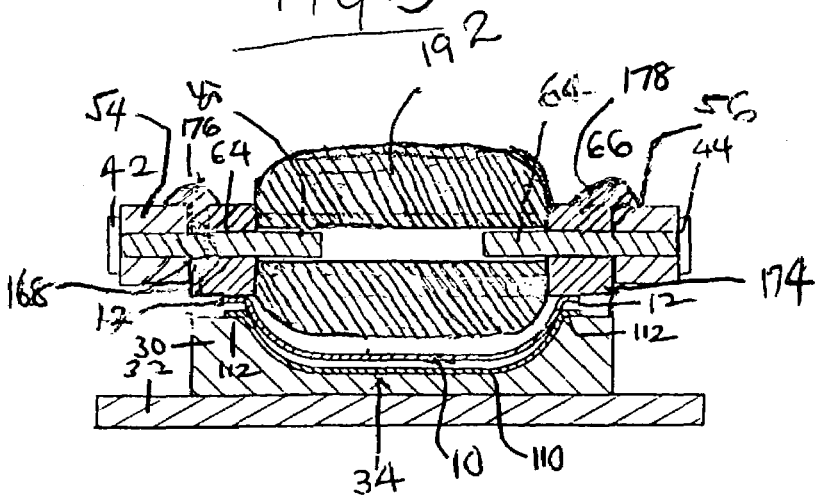
FIG. 15 shows a sectional front view of the embodiment of FIG. 14.

In FIG. 11 shows a top view of another embodiment of the invention, which includes the structure shown in FIG. 7. Base 30 stands on mounting plate 32, to which it is attached by conventional permanent fastening means, tray 10 sits on tray 110 (not shown in FIG. 11) in recess 34 (not shown in FIG. 11). Finger gap 36 is shown in base 30. Lugs 38 and 40 engage pivot pins 42 and 44 in pivot apertures 46 and 48. Pivot pins 42 and 44 have wear bushings 50 and 52, which engage lever arms 54 and 56. Extending through lever arms 54 and 56 through pin apertures 64 and 66 respectively are connector pins 58 and 60 which engage connector tube 62 internally. Journalled on connector pin 58 between connector tube 62 and lever arms 54 is spring-loaded gripping block 68 urged inward by spring 70 engaging recess 72. Journalled on connector pin 60 at the opposed end of connector tube 62 is fixed gripping block 74. As shown in FIGS. 12, 12A and 12B, gripping block 68 has groove 76 in its lower face and gripping block 74 has groove 78 in its lower face, these grooves are shaped and spaced to engage flange 12 of tray 10, which is rotatable downward to engage tray 110 in recess 34, to crush pills placed in tray 110. The grooves are angled at about 60° to the horizontal. As would be appreciated by those skilled in the art, lever arms 54 and 56 could be mounted internally as opposed to externally of lugs 38 and 40, while spring-loaded gripping block 68 can be mounted on either of connector pins 58 or 60. As shown in FIGS. 12, 12A, and 12B, grooves 76 and 78 are dimensioned to engage and hold flange 12 of tray 10. In FIG. 13, tray 10 is shown in contact with tray 110. The independent movement of blocks 68 and 74 allow relative movement of trays 10 and 110. Handle 96 is shown on lever arm 54. Lever arm 54 is shown in raised position in ghost as 154.

FIG. 14 shows a top view of another embodiment of the invention, which includes a similar structure to that shown in FIG. 7. Base 30 stands on mounting plate 32, to which it is attached by conventional permanent fastening means, tray 10 sits on tray 110 (not shown in FIG. 14) in recess 34 (not shown in FIG. 14). Finger gap 36 is shown in base 30. Lugs 38 and 40 engage pivot pins 42 and 44 in pivot apertures 46 and 48. Pivot pins 42 and 44 have wear bushings 50 and 52, which engage lever arms 54 and 56. Extending through lever arms 54 and 56 through pin apertures 64 and 66 respectively are connector pins 58 and 60 which pass through blocks 168 and 174 respectively. The pins also engage central passage 162 of cylindrical hammer 192, which has flat ends about ¾ inch in diameter, which engage the inner surface of blocks 168 and 174. Blocks 168 and 174 have top flanges 176 and 178, which engage the top of lever arms 54 and 56. As shown in FIGS. 16 and 17 block 168 has flange 176 with flat surface 182 to engage the top of lever arm 54, while block 168 has flat surface 180 to engage flange 12 of tray 10. The embodiment of FIGS. 14 to 17, works slightly better than the other versions. Hammer 192 registers and aligns trays 10 and 110 in recess 34, while blocks 168 and 174 press tray 10 down into tray 110. Flanges 176 and 178 allow a twist of blocks 168 and 174 of about 8 or 10° around pins 58 and 60 allowing rotational movement of the trays, they also allow a longitudinal wobble along pins 58 and 60 and thus trays to rock longitudinally. The embodiment of FIGS. 14 to 17, is preferred to the earlier versions, since it both registered the trays and engaged the tray flanges, and crushed well in test use, without adverse comment.

Although various forms of lever arm and handle are shown, these are illustrative only. The precise form of lever arm and handle is unimportant as long as it is operable, since these are of myriad form as would be known to those skilled in the art. The lever handles used are conventional.

As those skilled in the art would realize these preferred described details and materials and components can be subjected to substantial variation, modification, change, alteration, and substitution without affecting or modifying the function of the described embodiments.

Although embodiments of the invention have been described above, it is not limited thereto, and it will be apparent to persons skilled in the art that numerous modifications and variations form part of the present invention insofar as they do not depart from the spirit, nature and scope of the claimed and described invention.

I claim:

1. A pill crushing device comprising an anvil portion to receive a bottom tray with a flange to act as a mortar, said anvil comprising a recess having a perimeter adapted to engage said flange of said bottom tray, and a hammer portion to engage a top tray having a flange, said trays being substantially identical and nestable, opposed paired lever arms pivoted adjacent their ends about first paired aligned first opposed pivots in said anvil portion, said hammer portion being pivoted about second paired aligned second pivots spaced apart from said first pivots on said lever arms, said hammer portion having sockets engaging connecting pins forming said second pivots, said hammer portion being rotatable from a first upper position to a second lower position, wherein said hammer portion engages said top tray, said top tray engages said bottom tray, and said bottom tray engages said recess.

2. Pill crushing device of claim 1 wherein said sockets of said hammer portion engage said connecting pins with sufficient tolerance to allow said lever arms limited independent motion.

3. Pill crushing device of claim 2, wherein said hammer portion comprises a member of square cross section extending between said connecting pins.

4. Pill crushing device of claim 2, wherein said hammer portion comprises a member of rectangular cross section extending between said connecting pins.

5. Pill crushing device of claim 2, wherein said hammer portion registers with said trays and said recess.

6. Pill crushing device of claim 5, wherein said trays comprise a part cylindrical recess, with part spherical ends and a planar flange, and said hammer portion comprises a part cylindrical portion joining part spherical ends, said ends comprising said sockets.

7. Pill crushing device of claim 5, wherein said trays comprise a part cylindrical recess, with part spherical ends and a planar flange, and said hammer portion comprises a central cylindrical portion joining part spherical ends to register and align said cylindrical recess of said trays.

8. Pill crushing device of claim 5, wherein said trays comprise a part cylindrical recess, with part spherical ends and a planar flange, and said hammer portion comprises a central cylindrical portion to register and align said cylindrical recess of said trays, and end block portions to engage the flange of said top tray.

9. Pill crushing device of claim 2, wherein said trays comprise a part cylindrical recess, with part spherical ends and a planar flange, and said hammer portion comprises spring loaded means to engage said top tray.

10. Pill crushing device of claim 1, wherein said anvil portion additionally comprises a mounting plate, said anvil portion having therein a recess with a perimeter to receive a bottom tray having a part cylindrical mid portion, part spherical end portions and planar flange, said planar flange adapted to rest on said perimeter said hammer portion having a cylindrical mid portion and part spherical ends, sockets in said spherical ends engaging connecting pins forming said second pivots, said sockets engaging said connecting pins with sufficient tolerance to allow said lever arms limited independent motion.

11. Pill crushing device of claim 10, wherein said cylindrical portion of said hammer portion is substantially the same radius as said top tray and can fit inside said top tray.

12. Pill crushing device of claim 10, wherein said cylindrical portion of said hammer portion has a larger radius than said top tray and contacts said top tray only adjacent the top thereof.

13. Pill crushing device of claim 1, wherein said anvil portion additionally comprises a mounting plate, said anvil portion having therein a recess with a perimeter to receive a bottom tray having a part cylindrical mid portion, part spherical end portions and planar flange, said planar flange adapted to rest on said perimeter, said connecting pins passing through opposed gripping blocks, and engaging a connector tube with sufficient tolerance to allow said lever arms limited independent motion, one of said gripping blocks being spring loaded, both said gripping blocks engaging the end flange of a top tray having a part cylindrical mid portion, part spherical end portions and planar flange, said hammer portion being rotatable from a first upper position to a second lower position, wherein said hammer portion engages a top tray having a part cylindrical mid portion, part spherical end portions and planar flange, said top and bottom trays being substantially identical and nestable, said hammer means gripping and registering with said top tray, said top tray engages said bottom tray, and said bottom tray engages said recess.

14. Pill crushing device of claim 13, wherein both said gripping blocks comprise concave grooves to grip the end flange of said top tray.

15. Pill crushing device of claim 1, wherein said anvil portion additionally comprises a mounting plate, said anvil portion having therein a recess with a perimeter to receive a bottom tray having a part cylindrical mid portion, part spherical end portions and planar flange, said planar flange adapted to rest on said perimeter, said connecting pins passing through apertures in opposed end blocks, and engaging axial apertures in a central cylindrical hammer, with sufficient tolerance to allow said lever arms limited independent motion, both said end blocks engaging the end flange of a top tray having a part cylindrical mid portion, part spherical end portions and planar flange, said cylindrical portion of said hammer registering said cylindrical midportion of said upper tray, said hammer being rotatable from a first upper position to a second lower position, said top and bottom trays being substantially identical and nestable, said hammer means registering with said top tray, said top tray engages said bottom tray, and said bottom tray engages said recess.

16. Pill crushing device of claim 15, wherein both said end blocks comprise planar portions to engage the end flange of said top tray.

17. Pill crushing device of claim 1 wherein said trays comprise a concave inner surface comprising a central portion having a part cylindrical inner surface joining opposed end portions having spherical inner surfaces, said inner surfaces having a first radius, whereby said inner spherical surfaces merge smoothly into said inner cylindrical surface, and a convex outer surface comprising a central portion having a part cylindrical outer surface joining opposed end portions having spherical outer surfaces, said outer surfaces having a second radius greater than the first radius by the thickness of each said tray, said cylindrical surface forming a radial angle less than 180°, and each said tray comprises a surrounding flange lying in a plane which is chordal to the axis of rotation of said cylindrical surfaces.

18. Pill crushing device of claim 17 wherein said trays comprise stainless steel.

* * * * *